US009603429B2

(12) United States Patent
Paul et al.

(10) Patent No.: US 9,603,429 B2
(45) Date of Patent: Mar. 28, 2017

(54) METHOD FOR TREATING KERATINOUS FIBERS USING STEAM

(75) Inventors: Laurence Paul, Saint Leu la Foret (FR); Sandra Da Silva, Bessancout (FR)

(73) Assignee: L'OREAL, Paris (FR)

( * ) Notice: Subject to any disclaimer, the term of this patent is extended or adjusted under 35 U.S.C. 154(b) by 190 days.

(21) Appl. No.: 12/753,341

(22) Filed: Apr. 2, 2010

(65) Prior Publication Data

US 2010/0258141 A1 Oct. 14, 2010

Related U.S. Application Data

(60) Provisional application No. 61/180,193, filed on May 21, 2009.

(30) Foreign Application Priority Data

Apr. 3, 2009 (FR) ..... 09 52200

(51) Int. Cl.

| | |
|---|---|
| ***A61Q 5/06*** | (2006.01) |
| ***A45D 7/06*** | (2006.01) |
| ***A45D 7/02*** | (2006.01) |
| *A45D 1/00* | (2006.01) |

(52) U.S. Cl.

CPC ..... *A45D 7/06* (2013.01); *A45D 7/02* (2013.01); *A45D 2001/008* (2013.01)

(58) Field of Classification Search

None

See application file for complete search history.

(56) References Cited

U.S. PATENT DOCUMENTS

| | | | | |
|---|---|---|---|---|
| 3,745,306 | A | 7/1973 | Naritomi | |
| 4,166,473 | A | 9/1979 | Bauer et al. | |
| 4,205,692 | A | 6/1980 | Losenno | |
| 4,341,229 | A | 7/1982 | Bauer et al. | |
| 4,481,961 | A | 11/1984 | Bauer et al. | |
| 4,911,185 | A | 3/1990 | Losenno | |
| 5,046,516 | A | 9/1991 | Barradas | |
| 5,091,629 | A | 2/1992 | McGee | |
| 5,223,694 | A | 6/1993 | Tsuji et al. | |
| 5,520,199 | A | 5/1996 | Sturla | |
| 5,520,200 | A | 5/1996 | Sturla | |
| 5,520,706 | A | 5/1996 | Samain et al. | |
| 5,551,453 | A | 9/1996 | Sturla | |
| 5,585,307 | A | 12/1996 | Yoo | |
| 5,725,603 | A | 3/1998 | Audousset et al. | |
| 5,957,140 | A | 9/1999 | McGee | |
| 6,076,530 | A * | 6/2000 | Braida-Valerio et al. | 132/206 |
| 6,325,072 | B1 | 12/2001 | Smetana | |
| 6,521,219 | B1 | 2/2003 | Hirata | |
| 6,692,776 | B2 | 2/2004 | Hirata | |
| 7,044,139 | B2 | 5/2006 | Tong | |
| 2003/0124082 | A1 | 7/2003 | Hirata | |
| 2004/0000319 | A1 | 1/2004 | Carballada et al. | |
| 2005/0196368 | A1 * | 9/2005 | Laurent et al. | 424/70.2 |
| 2006/0108344 | A1 | 5/2006 | Kim et al. | |
| 2010/0224206 | A1 | 9/2010 | Serresvives et al. | |
| 2010/0242986 | A1 | 9/2010 | Serresvives et al. | |
| 2010/0247469 | A1 | 9/2010 | Kawabata et al. | |
| 2010/0288298 | A1 | 11/2010 | Serresvives et al. | |
| 2010/0307528 | A1 | 12/2010 | Restle et al. | |
| 2012/0111355 | A1 | 5/2012 | Vacheron et al. | |
| 2012/0111356 | A1 | 5/2012 | Vacheron et al. | |

FOREIGN PATENT DOCUMENTS

| | | | |
|---|---|---|---|
| FR | 2 921 804 | | 4/2009 |
| GB | 1512823 | | 6/1978 |
| JP | 62-181232 | U | 11/1987 |
| JP | 7-051119 | A | 2/1995 |
| JP | 7-163416 | A | 6/1995 |
| JP | 7-308220 | A | 11/1995 |
| JP | 2005-530583 | A | 10/2005 |
| JP | 2010-540137 | A | 12/2010 |
| JP | 2010-540143 | A | 12/2010 |
| WO | 0241857 | A1 | 5/2002 |
| WO | WO 03/039291 | | 5/2003 |
| WO | 2004/002263 | A1 | 1/2004 |
| WO | 2004002262 | A1 | 1/2004 |
| WO | 2004002263 | A1 | 1/2004 |
| WO | WO 2004/002262 | | 1/2004 |

OTHER PUBLICATIONS

French Search Report for FR 09/52200, dated Feb. 18, 2010.
English language Abstract of FR 2 921 804, dated Apr. 10, 2009.
International Search Report for PCT/EP2008/063246, dated Feb. 20, 2009.
English language Abstract of FR 2 848 075.
English language Abstract of JP 7-051119.
English language Abstract of JP 7-163416.
English translation of Japanese Office Action issued in related Japanese Patent Application 2010-527459, mailed Nov. 20, 2012.
U.S. Appl. No. 12/681,491, "Method for Treating the Hair Using Steam," Restle et al., filed Aug. 20, 2010.
Non-Final Office Action in U.S. Appl. No. 12/681,491, dated Jan. 11, 2012.
Final Office Action in U.S. Appl. No. 12/681,491, dated Jul. 23, 2012.
Non-Final Office Action in U.S. Appl. No. 12/681,491, dated Apr. 1, 2013.
English language abstract of FR 2 967 018.
English language abstract of FR 2 967 019.
English language abstract of FR 2 967 021.
English language abstract of FR 2 967 022.

(Continued)

*Primary Examiner* — Jyothsna Venkat
(74) *Attorney, Agent, or Firm* — The Marbury Law Group, PLLC

(57) ABSTRACT

Provided is a method for treating keratinous fibers comprising: applying steam to the keratinous fibers at a rate of less than 5 g/min; and shaping the keratinous fibers at a temperature of greater than 50° C., wherein the application of the steam and the shaping of the keratinous fibers do not occur simultaneously. The method disclosed herein may make it possible for example to obtain rapid shaping of the keratinous fibers while improving their cosmetic properties and the comfort of the user.

11 Claims, No Drawings

(56) References Cited

OTHER PUBLICATIONS

Machine translation of Japanese Office Action for Application No. JP 2010-527459, mailed Jul. 23, 2013.
English language translation of Japanese Office Action for JP 2010-085876, mailed May 26, 2014 (5 pages).
English language abstract of JP 7-051119 (Feb. 28, 1995).
English language abstract of JP 7-163416 (Jun. 27, 1995).

* cited by examiner

METHOD FOR TREATING KERATINOUS FIBERS USING STEAM

This application claims benefit of U.S. Provisional Application No. 61/180,193, filed May 21, 2009. This application also claims benefit of priority under 35 U.S.C. §119 to French Patent Application No. 09/52200, filed Apr. 3, 2009.

The present disclosure relates to a novel method for treating keratinous fibers, for example hair fibers such as hair.

It is known to smooth hair fibers with smoothing irons. These irons may make it possible to obtain smoothing of keratinous fibers at high temperature without pulling on the hair, in contrast to blow drying. However, in order to obtain a good smooth appearance, it may be necessary to carry out several passes of the iron, which considerably extends the hair treatment time. Furthermore, the repeated application of the flat smoothing irons can cause damage to the hair fibers due to the operating temperature of the smoothing iron.

It is also known to use steam for the treatment of the hair, it being possible for this steam treatment to be combined with various hair cosmetic treatments. For example, a hair treatment method is known in the field of hair setting (nonpermanent shaping) which comprises the application of steam, for a time of less than 2 minutes at a temperature of at least 75° C., to keratinous fibers held under mechanical tension and on which a specific cosmetic composition comprising, for example, an oil, a silicone, oxidation dyes, natural dyes, direct dyes and others has been applied beforehand. Non-limiting mention may be made, as examples, of EP 659 395, EP 659 393, EP 659 396 and EP 659 397.

Moreover, it is known to treat the hair with smoothing irons which deliver steam. However, these irons may not make it possible to obtain a satisfactory cosmetic effect as the heat dispensed by these irons is less than that dispensed by conventional smoothing irons. Mention may for example be made of WO 2004/002262, which describes such a method, the dispensed steam additionally comprising a nonvolatile shaping cosmetic product.

These methods, although improving the cosmetic and visual properties of the hair fibers, may be lengthy and often difficult to carry out. Moreover, the cosmetic effect obtained may not be persistent with regard to washing.

Thus, the aim of the present disclosure is to develop a novel method for treating keratinous fibers which may make it possible to obtain an improvement in the cosmetic and visual properties of hair fibers with methods which are easy and rapid to carry out and which are persistent with regard to at least one washing.

Accordingly, disclosed herein is a method for treating keratinous fibers comprising:

(i) applying steam to the keratinous fibers at a rate of less than 5 g/min, and (ii) shaping the keratinous fibers at a temperature of greater than 50° C., wherein the application of the steam and the shaping of the keratinous fibers do not occur simultaneously.

In other words, for a treated lock of hair fibers, the application of steam and the shaping of the hair fibers do not occur simultaneously on the same portion of hair fibers. For example, it is possible for both to be carried out with the same device configured to carry them out successively. Alternatively, two separate devices can be used to carry out the application of the steam and the shaping of the hair fibers.

The method disclosed herein may make it possible for example to obtain rapid shaping of hair fibers while improving their cosmetic properties. Furthermore, the method disclosed herein may make it possible to obtain an improvement in the cosmetic properties which is persistent with regard to at least one washing, and an improvement in user comfort on application.

The hair fibers treated by the method disclosed herein may thus exhibit an improved smoothing with a shinier appearance than that obtained with the methods of the art, this being the case even in the absence of additional cosmetic active principles.

In the context of the present disclosure, the term "hair fibers" is understood to mean keratinous fibers, such as the hair, or synthetic fibers, referred to as "extensions," which are intended to be attached to the hair of a person by various methods, for example by adhesive bonding, this being done to modify the appearance of the natural hair of a person, for example by modifying the volume, the color, or the appearance of the hair.

The application of steam can be carried out before or after shaping the hair fibers. According to at least one embodiment, the shaping of the hair fibers may occur after the treatment of the hair fibers with steam.

The application of steam can be repeated several times on the same fibers; however, it may be possible to obtain a very good cosmetic result after a single application of steam.

According to at least one embodiment of the method disclosed herein, the steam may be applied at a rate ranging from 1 to 4 g/min.

According to at least one embodiment, the steam applied to the hair may comprise at least one cosmetic active principle and/or ingredient such as a fragrance, a shaping or conditioning active principle, etc.

The application of steam can be carried out using any device known per se for generating the disclosed rate of steam. According to at least one embodiment, the device is portable, that is to say that the tank which makes it possible to generate the steam is in contact with the part of the device comprising the orifices for dispensing the steam.

The shaping of the hair fibers can be carried out with any type of known device of the art capable of shaping the hair fibers at a temperature of at least 50° C. The device for shaping the hair fibers may be, for example, devices exhibiting a heating surface capable of coming into contact with the hair fibers and of applying a tension, even a light tension, to the fibers which may make it possible to smooth, style, or disentangle the hair fibers.

According to at least one embodiment of the method disclosed herein, the shaping temperature is greater than 90° C., for example ranging from 90° C. to 230° C., such as ranging from 150° C. to 200° C.

According to another embodiment, shaping may be carried out using smoothing irons. Non-limiting mention may for example be made of the flat smoothing irons described in U.S. Pat. Nos. 5,957,140, 5,046,516, 7,044,139, 5,223,694, and 5,091,629.

Although the shaping, such as the smoothing, of the hair fibers can be carried out several times, satisfactory results may be obtained with a single pass of the smoothing iron.

The method disclosed herein may make it possible, for example when the application of the steam is carried out before the shaping, to sufficiently hydrate the fibers in order to reduce the damage to the fibers during the implementation of the shaping at a temperature of greater than 50° C.

When the application of the steam takes place after the shaping, the steam may rehydrate the fibers, reducing in the same way the damage to hair fibers.

For example, the shaping may occur after the treatment with steam.

According to at least one embodiment, the method disclosed herein further comprises cosmetically treating the keratinous fibers comprising applying to the keratinous fibers a composition comprising at least one cosmetic active principle.

The cosmetic treatment can be carried out before or after the application of the steam and/or before or after the shaping of the hair fibers. It should for example be noted that this cosmetic treatment is not carried out simultaneously with the application of the steam.

According to at least one embodiment, the method disclosed herein comprises, in order, cosmetically treating the hair fibers, followed by applying steam to the hair fibers, and then shaping the hair fibers.

According to at least one embodiment, the method disclosed herein comprises, in order, applying steam to the hair fibers, followed by shaping the hair fibers, and then cosmetically treating the hair fibers.

According to at least one embodiment, the method disclosed herein comprises, in order, applying steam to the hair fibers, followed by cosmetically treating the hair fibers and then shaping the hair fibers.

According to at least one embodiment, the method disclosed herein can further comprise a second posttreatment or pretreatment of the hair fibers, identical to or different from the first cosmetic treatment.

The cosmetic treatment comprises at least one treatment chosen from: caring for the hair fibers, which may or may not be followed by a rinsing, washing the hair fibers, shaping or controlling the shape of the hair fibers, for example by applying a fixing gel, a shaping mousse, a lacquer, or a leave-in conditioner in cream form, permanent, semipermanent, or temporary dyeing the hair fibers, permanent deformation of the hair fibers using a reducing agent and optionally a fixative, and alkaline straightening the hair fibers with sodium hydroxide or with guanidine carbonate.

Non-limiting mention may be made, as examples of the at least one cosmetic active principle, of dye precursors, direct dyes, silicone or nonsilicone and fixing or nonfixing polymers, mineral, vegetable or synthetic oils, waxes, reducing agents, oxidizing agents, UV screening agents, conditioning agents, agents for combating free radicals, sequestering or stabilizing agents, antioxidants, preservatives, acidifying agents, alkaline agents, fragrances, volatile or nonvolatile silicones, reactive or chemically inert polymers, pigments, solid organic or inorganic particles, thickeners, vitamins, plant extracts, propenetrating agents, or agents for swelling the fiber.

As an example, non-limiting mention may be made, for instance, of noncolorant, nonpolymeric cationic cosmetic agents comprising at least one cationic unit and having at least one fatty chain.

By "noncolorant" is meant, for the purposes of the present disclosure, not having, in its structure, a chromophore exhibiting absorption maxima in the visible range.

By "fatty chain" is meant, for the purposes of the present disclosure, any hydrocarbon chain containing at least 8 carbon atoms, such as from 8 to 30 carbon atoms.

The cationic cosmetic agent(s) defined above may be selected from primary, secondary, tertiary, and quaternary, aliphatic, or cyclic amine groups. The amine groups may for example be quaternary.

Accordingly, the cationic cosmetic agent(s) used according to the disclosed method may be generally selected from cationic surfactants.

By way of example, non-limiting mention may be made of optionally polyalkoxylated primary, secondary or tertiary fatty amine salts; quaternary ammonium salts with charge not included in a ring and without an ester function; quaternary imidazoline derivatives; quaternary diammonium salts; quaternary ammonium salts with at least one ester function; and/or a mixture thereof.

The quaternary ammonium salts with charge not included in a ring and without an ester function are for example:

those having the following general formula (I):

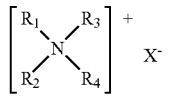

(I)

wherein the radicals $R_1$ to $R_4$, which may be identical or different, represent a linear or branched aliphatic radical containing from 1 to 30 carbon atoms, or an aromatic radical such as $C_6$-$C_{30}$ aryl or alkyl($C_1$-$C_6$)aryl($C_6$-$C_{30}$). The aliphatic radicals may contain heteroatoms such as, for example, oxygen, nitrogen, sulphur and halogens. The aliphatic radicals are for example chosen from alkyl, alkoxy, polyoxyalkylene($C_2$-$C_6$), alkylamide, alkyl($C_{12}$-$C_{22}$)amidoalkyl($C_2$-$C_6$), alkyl($C_{12}$-$C_{22}$)acetate and hydroxyalkyl radicals containing approximately from 1 to 30 carbon atoms; X is an anion chosen from halides, phosphates, acetates, lactates, alkyl($C_1$-$C_6$)sulphates, alkyl($C_1$-$C_6$)— and alkyl($C_1$-$C_6$)aryl($C_6$-$C_{30}$-sulphonates. For example, $R_1$ and $R_2$ denote a $C_1$-$C_4$ alkyl or a $C_1$-$C_4$ hydroxyalkyl.

quaternary ammonium salts of imidazoline, such as, for example, that of formula (II) below:

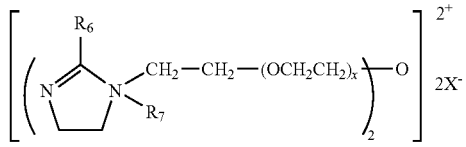

(II)

wherein R6 represents an alkenyl or alkyl radical containing from 8 to 30 carbon atoms, R7 represents a C1-C6 alkyl or C1-C6 hydroxyalkyl radical, X— is an anion chosen from halides, phosphates, acetates, lactates, alkyl(C1-C6) sulphates, alkyl(C1-C6)- and alkyl(C1-C6)aryl(C6-C30)-sulphonates, with x denoting an integer from 0 to 100, such as from 0 to 20. As a compound of formula (II), non-limiting mention may be made of Quaternium-56.

quaternary diammonium salts of formula (III):

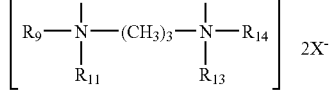

(III)

wherein R9 denotes an aliphatic radical containing approximately from 16 to 30 carbon atoms, R10, R11, R12, R13 and R14, which are identical or different, are chosen from hydrogen and an alkyl radical containing from 1 to 4 carbon atoms, and X— is an anion chosen from halides, acetates, phosphates, nitrates and methylsulphates. Quaternary diammonium salts of formula (III) that are suitable for the composition disclosed herein comprise, for example, propanetallow-diammonium chloride.

quaternary ammonium salts comprising at least one ester function, for example those of formula (IV) below:

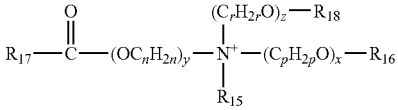

(IV)

wherein:

R15 is selected from $C_1$-$C_6$ alkyl radicals and $C_1$-$C_6$ hydroxyalkyl or dihydroxyalkyl radicals;

R16 is selected from:

the radical

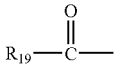

linear or branched, saturated or unsaturated C1-C22 hydrocarbon radicals R20, hydrogen atom, R18 is selected from:

the radical

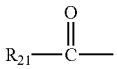

linear or branched, saturated or unsaturated C1-C6 hydrocarbon radicals R22, hydrogen atom, R17, R19 and R21, which are identical or different, are selected from linear or branched, saturated or unsaturated C7-C21 hydrocarbon radicals;

n, p and r, which are identical or different, are integers from 2 to 6;

y is an integer from 1 to 10;

x and z, which are identical or different, are integers from 0 to 10;

X— is a simple or complex, organic or inorganic anion.

The alkyl radicals R15 may be linear or branched, for example linear.

For instance, R15 denotes a methyl, ethyl, hydroxyethyl or dihydroxypropyl radical, such as a methyl or ethyl radical.

In at least one embodiment, the sum x+y+z ranges from 1 to 10.

When R16 is a hydrocarbon radical R20, it may be long and may have 12 to 22 carbon atoms, or may be short and may have from 1 to 3 carbon atoms.

When R18 is a hydrocarbon radical R22, it may have for example 1 to 3 carbon atoms.

For instance, x and z, which are identical or different, may be 0 or 1.

In at least one embodiment, y is 1.

For instance, n, p and r, which are identical or different, are 2 or 3, such as 2.

The anion is for example a halide (chloride, bromide or iodide) or an alkylsulphate, such as methylsulphate. It is possible, however, to use methanesulphonate, phosphate, nitrate, tosylate, an anion derived from an organic acid, such as acetate or lactate, or any other anion which is compatible with the ester-functional ammonium.

The anion X— is for example still chloride or methylsulphate.

In at least one embodiment, the hydrocarbon radicals are linear.

Among the quaternary ammonium salts of formula (I), non-limiting mention may be made, on the one hand, of tetraalkylammonium chlorides such as, for example, alkyltrimethylammonium chlorides wherein the alkyl radical contains approximately 12 to 22 carbon atoms, for example behenyltrimethylammonium chloride, cetyltrimethylammonium chloride and benzyldimethylstearylammonium chloride, or else, on the other hand, to palmitylamidopropyltrimethylammonium chloride or the stearamidopropyldimethyl(myristyl acetate)ammonium chloride sold under the name "CERAPHYL 70" by Van Dyk.

Non-limiting mention may also be made of the ammonium salts containing at least one ester function that are described in U.S. Pat. No. 4,874,554.

Quaternary ammonium salts of formula (IV) that may be suitable for the composition disclosed herein include, for example, the dipalmitoylethylhydroxyethylammonium methosulphate sold by Stepan under the name STEPANQUAT GA 90.

For example, cationic molecules which can be used in the composition disclosed herein are the compounds of formula (I) or of formula (IV).

For example, cetyltrimethylammonium chloride may be used.

As explained above, the cationic molecule(s) may also be selected from cationic proteins.

The cationic cosmetic agent(s) represent for example from 0.1% to 10% by weight of the total weight of the composition, with the proviso that, if the cationic cosmetic agent is a tetraalkylammonium salt containing only a single fatty chain, it is present at a level greater than or equal to 1% by weight, relative to the total weight of the composition. For example, the cationic cosmetic agent(s) used in the composition disclosed herein, irrespective of their nature, represent from 1% to 10%, for example from 1% to 5%, by weight of the total weight of the composition.

According to at least one embodiment, when the cationic cosmetic agent(s) contain two fatty chains, they do not contain any amide function.

As an example, non-limiting mention may be made, as the at least one cosmetic active principle useful in the method disclosed herein, of noncolorant cationic polymers which are not derived from a sugar or from a silicone, and which have a cationic charge density of more than 1.5 meq/g.

The charge density may be determined in accordance with the Kjeldahl method. It is measured in general at a pH of the order ranging from 3 to 9.

The cationic polymers used in the method disclosed herein for example have a cationic charge density of less than 10 meq/g.

A "cationic polymer," for the purposes of the present disclosure, is any polymer containing cationic groups and/or groups which can be ionized to cationic groups.

By "noncolorant" is meant, for the purposes of the present disclosure, not having, in its structure, a chromophore exhibiting an absorption maximum in the visible range.

By "not derived from a sugar or from a silicone" is meant, for the purposes of the present disclosure, not comprising, in its structure, a sugar unit (mono-, oligo-, or polysaccharide) or a unit containing at least one silicon atom.

The cationic polymers which can be used in accordance with the method disclosed herein may be selected from all of those already known per se to enhance the cosmetic properties of hair treated with detergent compositions, these being, for example, the polymers described in EP Patent Application EP-A-0 337 354 and in French Patent Applications FR-A-2 270 846, 2 383 660, 2 598 611, 2 470 596 and 2 519 863.

For example, cationic polymers may be selected from those which contain units comprising primary, secondary, tertiary, and/or quaternary amine groups, which may either form part of the main polymer chain or may be carried by a side substituent directly connected to said chain.

The cationic polymers used may have a weight-average molecular mass of more than 105, for example more than 106, such as ranging from 106 to 108.

The cationic polymers, in at least one embodiment, are not polyurethanes.

The cationic polymers which can be used according to the method disclosed herein include, for example, polymers of polyamine, polyaminoamide, and polyquaternary ammonium type. These are known products.

The polymers of polyamine, polyaminoamide, and polyquaternary ammonium type that can be used in the composition of the present disclosure include those described in French Patents 2 505 348 and 2 542 997. These polymers include the following:

(1) homopolymers or copolymers which are derived from acrylic or methacrylic esters or amides and comprise at least one of the units of the following formulae:

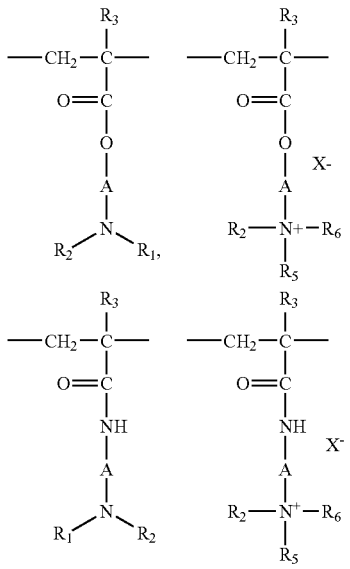

wherein:

$R_1$ and $R_2$, which are identical or different, represent a hydrogen atom or an alkyl group having from 1 to 6 carbon atoms, such as a methyl or ethyl group;

$R_3$, identical or different at each occurrence, denotes a hydrogen atom or a $CH_3$ group;

the symbols A, which are identical or different, represent a linear or branched alkyl group containing from 1 to 6 carbon atoms, such as 2 or 3 carbon atoms, or a hydroxyalkyl group containing from 1 to 4 carbon atoms;

$R_4$, $R_5$ and $R_6$, which are identical or different, represent an alkyl group having from 1 to 18 carbon atoms or a benzyl group, such as an alkyl group having from 1 to 6 carbon atoms;

X denotes an anion derived from an organic or inorganic acid, such as a methosulphate anion, or a halide such as chloride or bromide.

The copolymers of class (1) may further comprise at least one unit derived from comonomers selectable from the class of acrylamides, methacrylamides, diacetoneacrylamides, acrylamides, and methacrylamides which are substituted on the nitrogen atom with lower ($C_1$-$C_4$)alkyl groups, with groups derived from acrylic or methacrylic acids or from esters thereof, from vinyl lactams such as vinylpyrrolidone or vinylcaprolactam, or from vinyl esters.

Accordingly, these copolymers of class (1) may include:

copolymers of acrylamide and dimethylaminoethyl methacrylate quaternized with dimethyl sulphate or with a dimethyl halide, copolymers of acrylamide and methacryloyloxyethyltrimethylammonium chloride, which are described, for example, in Patent Application EP-A-080 976, copolymers of acrylamide and methacryloyloxyethyltrimethylammonium methosulphate, quaternized or nonquaternized vinylpyrrolidone/dialkylaminoalkyl acrylate or methacrylate copolymers. These polymers are described in French Patents 2 077 143 and 2 393 573, dimethylaminoethyl methacrylate/vinylcaprolactam/vinylpyrrolidone terpolymers, vinylpyrrolidone/methacrylamidopropyldimethylamine copolymers, vinylpyrrolidone/quaternized dimethylaminopropylmethacrylamide copolymers, and crosslinked polymers of methacryloyloxyalkyl($C_1$-$C_4$)trialkyl($C_1$-$C_4$)ammonium salts, such as the polymers obtained by homopolymerization of dimethylaminoethyl methacrylate quaternized with methyl chloride, or by copolymerization of acrylamide with dimethylaminoethyl methacrylate quaternized with methyl chloride, the homopolymerization or copolymerization being followed by crosslinking with an olefinically unsaturated compound, for example methylenebisacrylamide. Use may be made for instance of a crosslinked acrylamide/methacryloyloxyethyltrimethylammonium chloride (20/80 by weight) copolymer in the form of a dispersion containing 50% by weight of said copolymer in mineral oil. This dispersion is sold under the name SALCARE® SC 92 by Ciba. Use may also be made, for instance, of a crosslinked homopolymer of methacryloyloxyethyltrimethylammonium chloride containing approximately 50% by weight of the homopolymer in mineral oil or in a liquid ester. These dispersions are sold under the names SALCARE® SC 95 and SALCARE® SC 96 by Ciba.

(2) Polymers composed of piperazinyl units and of divalent alkylene or hydroxyalkylene groups containing linear or branched chains, optionally interrupted by oxygen, sulphur or nitrogen atoms or by aromatic or heterocyclic rings, and also the oxidation and/or quaternization products of these polymers. Polymers of these kinds are described for example in French Patents 2 162 025 and 2 280 361.

(3) Water-soluble polyaminoamides prepared for instance by polycondensation of an acidic compound with a polyamine; these polyaminoamides may be crosslinked with an epihalohydrin, a diepoxide, a dianhydride, an unsaturated dianhydride, a bisunsaturated derivative, a bishalohydrin, a bisazetidinium, a bishaloacyldiamine, a bisalkyl halide or alternatively with an oligomer resulting from the reaction of a difunctional compound which is reactive towards a bishalohydrin, a bisazetidinium, a bishaloacyldiamine, a bisalkyl halide, an epihalohydrin, a diepoxide or a bisunsaturated derivative; the crosslinking agent is used in proportions of from 0.025 to 0.35 mol per amine group of the polyaminoamide; these polyaminoamides may be alkylated or, if they contain at least one tertiary amine function, quaternized. Polymers of these kinds are described for example in French Patents 2 252 840 and 2 368 508.

(4) Polyaminoamide derivatives resulting from the condensation of polyalkylene-polyamines with polycarboxylic acids, followed by alkylation with difunctional agents. Non-limiting mention may be made, for example, of adipic acid/dialkylaminohydroxyalkyl-dialkylenetriamine polymers wherein the alkyl group contains from 1 to 4 carbon atoms and denotes for example a methyl, ethyl or propyl group, and the alkylene group contains from 1 to 4 carbon atoms and denotes for example the ethylene group. Polymers of these kinds are described for instance in French Patent 1 583 363.

Among these derivatives, non-limiting mention may be made for example of adipic acid/dimethylaminohydroxypropyl-diethylenetriamine polymers.

(5) Polymers obtained by reacting a polyalkylene-polyamine containing two primary amine groups and at least one secondary amine group with a dicarboxylic acid selected from diglycolic acid and saturated aliphatic dicarboxylic acids having from 3 to 8 carbon atoms. The molar ratio between the polyalkylene-polyamine and the dicarboxylic acid ranges from 0.8:1 to 1.4:1, and the resultant polyaminoamide is reacted with epichlorohydrin in a molar ratio of epichlorohydrin relative to the secondary amine group of the polyaminoamide ranging from 0.5:1 to 1.8:1. Polymers of these kinds are described for example in U.S. Pat. Nos. 3,227,615 and 2,961,347.

(6) Alkyldiallylamine or dialkyldiallylammonium cyclopolymers, such as the homopolymers or copolymers containing, as the main constituent of the chain, units conforming to the formula (Ia) or (Ib):

(Ia)

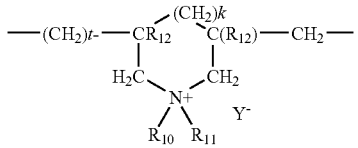

(Ib)

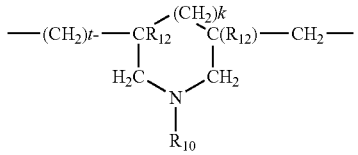

wherein k and t are 0 or 1, the sum k+t being equal to 1; $R_{12}$ denotes a hydrogen atom or a methyl group; $R_{10}$ and $R_{11}$, independently of one another, denote an alkyl group having from 1 to 6 carbon atoms, a hydroxyalkyl group in which the alkyl group has for example 1 to 5 carbon atoms, a lower ($C_1$-$C_4$) amidoalkyl group, or $R_{10}$ and $R_{11}$ may denote, jointly with the nitrogen atom to which they are attached, heterocyclic groups, such as piperidinyl or morpholinyl; $Y^-$ is an anion such as bromide, chloride, acetate, borate, citrate, tartrate, bisulphate, bisulphite, sulphate or phosphate. These polymers are described for example in French Patent 2 080 759 and in its Certificate of Addition 2 190 406.

R10 and R11, independently of one another, for example denote an alkyl group having from 1 to 4 carbon atoms.

Among the polymers defined above, non-limiting mention may be made for example of the dimethyldiallylammonium homopolymer, such as the dimethyldiallylammonium chloride sold under the name MERQUAT® 100 by Nalco (and its low weight-average molecular mass homologues), the copolymers of diallyldimethylammonium chloride and acrylamide that are sold under the name MERQUAT® 550, and the copolymers of diallyldimethylammonium and acrylic acid such as MERQUAT® 295 sold by Nalco.

(7) Quaternary diammonium polymers, for example those containing repeating units conforming to the formula (II) below:

(II)

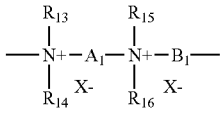

wherein:

$R_{13}$, $R_{14}$, $R_{15}$ and $R_{16}$, which are identical or different, represent aliphatic, alicyclic or arylaliphatic groups containing from 1 to 20 carbon atoms, or lower hydroxyalkylaliphatic groups, or else $R_{13}$, $R_{14}$, $R_{15}$ and $R_{16}$, together or separately, constitute, with the nitrogen atoms to which they are attached, heterocycles optionally containing a second heteroatom other than the nitrogen, or else $R_{13}$, $R_{14}$, $R_{15}$ and $R_{16}$ represent a linear or branched $C_1$-$C_6$ alkyl group which is substituted by a nitrile, ester, acyl, amide or —CO—O—$R_{17}$-E or —CO—NH—$R_{17}$-E group wherein $R_{17}$ is an alkylene group and E is a quaternary ammonium group;

$A_1$ and $B_1$ represent polymethylene groups containing from 2 to 20 carbon atoms, which may be linear or branched and saturated or unsaturated and may contain, bonded to or intercalated in the main chain, at least one aromatic ring, or at least one entity chosen from oxygen and sulphur atoms and sulphoxide, sulphone, disulphide, amino, alkylamino, hydroxyl, quaternary ammonium, ureido, amide and ester groups, and $X^-$ denotes an anion derived from an organic or inorganic acid, such as acetate, borate, citrate, tartrate, bisulphate, bisulphite, sulphate, phosphate, methosulphate or a halide such as chloride or bromide, $A_1$, $R_{13}$ and $R_{15}$ may form, with the two nitrogen atoms to which they are attached, a piperazine ring; moreover, if $A_1$ denotes a saturated or unsaturated, linear or branched alkylene or hydroxyalkylene group, $B_1$ may also denote a group:

$$—(CH_2)_n—CO\text{-}E'\text{-}OC—(CH_2)_n—$$

wherein E' denotes:

a) a glycol residue of formula —O—Z—O—, wherein Z denotes a linear or branched hydrocarbon group, or a group conforming to one of the following formulae:

$$—(CH_2—CH_2—O)_x—CH_2—CH_2—$$

$$—[CH_2—CH(CH_3)—O]_y—CH_2—CH(CH_3)—$$

where x and y denote an integer from 1 to 4, representing a single, defined degree of polymerization, or any number from 1 to 4, representing an average degree of polymerization;

b) a bis-secondary diamine residue such as a piperazine derivative;

c) a bis-primary diamine residue of formula —NH—Y—NH—, where Y denotes a linear or branched hydrocarbon group, or else the divalent group $—CH_2—CH_2—S—S—CH_2—CH_2—$;

d) a ureylene group of formula —NH—CO—NH—.

For example, X— may be an anion such as halide such as chloride or bromide.

Polymers of this type are described for example in French Patents 2 320 330, 2 270 846, 2 316 271, 2 336 434 and 2 413 907 and U.S. Pat. Nos. 2,273,780, 2,375,853, 2,388,614, 2,454,547, 3,206,462, 2,261,002, 2,271,378, 3,874,870, 4,001,432, 3,929,990, 3,966,904, 4,005,193, 4,02,617, 4,025,627, 4,025,653, 4,026,945 and 4,027,020.

Use may be made for example of polymers which are composed of repeating units conforming to the formula:

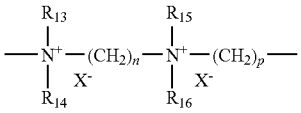

(III)

wherein $R_{13}$, $R_{14}$, $R_{15}$ and $R_{16}$, which are identical or different, denote an alkyl or hydroxyalkyl group having from about 1 to 4 carbon atoms, n and p are integers varying from 2 to 20 approximately, and $X^-$ is an anion derived from an organic or inorganic acid as defined above.

For example, the compound of formula (III) may be that for which R13, R14, R15, and R16 represent a methyl radical and n=3, p=6 and X=Cl, which is called Hexadimethrine chloride according to the INCI (CTFA) nomenclature.

(8) Polyquaternary ammonium polymers composed of units of formula (IV):

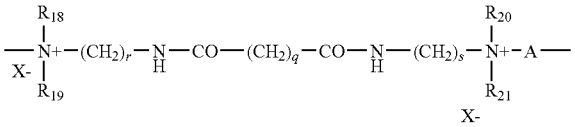

(IV)

wherein:

$R_{18}$, $R_{19}$, $R_{20}$ and $R_{21}$, which are identical or different, represent a hydrogen atom or a methyl, ethyl, propyl, β-hydroxyethyl, β-hydroxypropyl or $—CH_2CH_2(OCH_2CH_2)_pOH$ group, wherein p is 0 or an integer ranging from 1 to 6, with the proviso that $R_{18}$, $R_{19}$, $R_{20}$ and $R_{21}$ do not simultaneously represent a hydrogen atom, r and s, which are identical or different, are integers ranging from 1 to 6, q is 0 or an integer ranging from 1 to 34, $X^-$ denotes an anion such as a halide, A denotes a radical of a dihalide or represents for example $—CH_2—CH_2—O—CH_2—CH_2—$.

Compounds of this kind are described for instance in Patent Application EP-A-122 324.

(9) Quaternary polymers of vinylpyrrolidone and of vinylimidazole, such as, for example, the products sold under the names LUVIQUAT® FC 905, FC 550 and FC 370 by BASF.

Other cationic polymers which can be used in the context of the present disclosure are polyalkyleneimines, for example polyethyleneimines, polymers containing vinylpyridine or vinylpyridinium units, condensates of polyamines and epichlorohydrin, and quaternary polyureylenes.

According to at least one embodiment, the cationic polymers which can be used according to the present disclosure have a permanent cationic charge, corresponding to the presence of units containing quaternary amine groups.

The cationic polymers of the present disclosure for example may be selected from dialkyldiallylammonium cyclopolymers and quaternary diammonium polymers of formula (II).

The cationic polymer or polymers represent for example from 0.1% to 10%, such as from 0.2% to 8%, by weight of the total weight of the composition.

The cosmetic treatment may comprise applying a composition in the form of a thickened or nonthickened lotion, of a cream, or of a gel or in any other appropriate form.

The compositions used are generally aqueous compositions which can comprise ingredients commonly used in cosmetic compositions, such as solvents, surface-active agents, thickeners, preservatives, fragrances, or any other additive used in this type of composition.

According to at least one embodiment, the method disclosed herein can comprise an additional final shaping, for example a smoothing, for instance if preceded by a cosmetic treatment.

The following examples, without, however, being limiting in nature, illustrate the method disclosed herein employed in several hair cosmetic applications.

EXAMPLE 1

Locks of hair were washed and wrung out. The hair was then predried until drying of approximately 80% was obtained.

Steam was applied to the predried locks at a rate of approximately 3 g/min, followed by shaping/smoothing via a smoothing iron heated to at least 100° C. This treatment was carried out lock by lock over the entire head of hair.

A permanent oxidation dye with a shade of 5.64 (coppery red light chestnut from the Majirouge range) was subsequently applied, an operation which consisted in applying, to the hair fibers, at least one oxidation base and at least one coupler well known in the field of permanent dyeing, in the presence of an oxidizing agent (hydrogen peroxide).

At the same time, the above test was carried out, but without applying steam or shaping under the preceding conditions, but rather while smoothing with a conventional heating smoothing iron.

It was observed that the hair treated with the steam was shinier and smoother than the hair treated solely with the conventional heating smoothing iron.

After several shampooings, the color on the hair treated with the steam was observed to last longer.

EXAMPLE 2

A reducing cream comprising thioglycolic acid salts was applied with a brush to locks of washed and wrung-out hair. After the setting time, the locks were again rinsed, then wrung out and predried to 80% using a hairdryer.

Steam was applied to the predried fibers under the conditions defined above, followed by shaping/smoothing via a smoothing iron heated to at least 100° C. This treatment was carried out lock by lock over the entire head of hair.

The fixative was subsequently applied to the entire head of hair. After a setting time, the locks were rinsed, wrung out, and dried.

At the same time, the above test was carried out, but without applying steam or shaping under the preceding conditions, but rather while smoothing with a conventional heating smoothing iron.

It was observed that the hair treated with the method disclosed herein was shinier and smoother to the touch and visually. The hair was furthermore markedly better straightened with the method disclosed herein.

After several shampooings, it was found that the smoothing effect persisted when obtained with the method disclosed herein.

EXAMPLE 3

The care product "Ciment thermique" from Kerastase, a leave-in care product comprising silicones and cationic surfactants, was applied to washed and wrung-out locks of hair. The locks were then predried until drying of approximately 80% was obtained.

Steam was applied to the predried locks under the conditions defined above, followed by shaping/smoothing via a smoothing iron heated to at least 100° C.

At the same time, the above test was carried out, but without applying steam or shaping under the preceding conditions, but rather while smoothing with a conventional heating smoothing iron.

It was observed that the locks treated according to the method disclosed herein were shinier and smoother to the touch and visually. The hair was markedly better smoothed.

After several shampooings, it was found that the smoothing effect persisted when obtained with the method disclosed herein.

EXAMPLE 4

A conditioner "Nutriceramide" of the Elsève brand was applied to washed and wrung-out locks of hair. After the setting time, the locks were rinsed, then wrung out and predried to 80% using a hairdryer.

Steam was applied to the predried locks under the conditions defined above, followed by shaping/smoothing via a smoothing iron heated to at least 100° C.

At the same time, the above test was carried out, but without applying steam or shaping under the preceding conditions, but rather while smoothing with a conventional heating smoothing iron.

It was observed that the locks treated with the method disclosed herein were shinier and smoother to the touch and visually. The locks were markedly better smoothed.

After several shampooings, it was found that the smoothing effect persisted when obtained with the method disclosed herein.

EXAMPLE 5

Locks of hair were washed and wrung out. The hair was then predried until drying of approximately 80% was obtained.

Steam was applied to the predried locks under the conditions defined above, followed by shaping/smoothing via a smoothing iron heated to at least 100° C. This treatment was carried out lock by lock over the entire head of hair.

At the same time, the above test was carried out but without applying steam, but rather while smoothing with a conventional heating smoothing iron without application of steam.

It was observed that the hair treated with the steam was shinier and smoother than the hair treated solely with the conventional heating smoothing iron.

What is claimed is:

1. A method for treating keratinous fibers comprising in at least one pass:

applying steam to a portion of the keratinous fibers at a rate of less than 5 g/min, and subsequently shaping the same portion of the keratinous fibers with a smoothing iron at a temperature of greater than 50° C., wherein the application of the steam and the shaping of the keratinous fibers do not occur simultaneously on the same portion of the keratinous fibers, and wherein the method does not comprise a step of applying steam to the same portion of the keratinous fibers after the shaping step in the same pass.

2. A method according to claim 1, wherein the keratinous fibers are hair fibers.

3. A method according to claim 1, wherein the steam is applied at a rate ranging from 1 to 4 g/min.

4. A method according to claim 1, wherein the shaping temperature is greater than 90° C.

5. A method according to claim 4, wherein the shaping temperature ranges from 90° C. to 230° C.

6. A method according claim 1, wherein the shaping is carried out using a smoothing iron.

7. A method according to claim 6, wherein the shaping comprises smoothing in a single pass per treated lock of keratinous fibers.

8. A method according to claim 1, wherein applying steam to the keratinous fibers comprises a single application of steam per lock of treated keratinous fibers.

9. A method according to claim 1, wherein the steam comprises at least one cosmetic active principle and/or ingredient.

10. A method according to claim 1, further comprising cosmetically treating the keratinous fibers comprising applying to the keratinous fibers a composition comprising at least one cosmetic active principle.

11. A method according to claim 10, comprising, in order, cosmetically treating the keratinous fibers, followed by applying the steam to the keratinous fibers, and then shaping the keratinous fibers, wherein the application of the steam and the shaping of the keratinous fibers occur successively using the same device.

* * * * *